US008333557B2

(12) United States Patent
John et al.

(10) Patent No.: US 8,333,557 B2
(45) Date of Patent: Dec. 18, 2012

(54) VORTEX CHAMBERS FOR CLEARANCE FLOW CONTROL

(75) Inventors: Joshy John, Karnataka (IN); Sanjeev Kumar Jain, Karnataka (IN); Sachin Kumar Rai, Jharkhand (IN)

(73) Assignee: General Electric Company, Schenectady, NY (US)

( * ) Notice: Subject to any disclaimer, the term of this patent is extended or adjusted under 35 U.S.C. 154(b) by 600 days.

(21) Appl. No.: 12/578,770

(22) Filed: Oct. 14, 2009

(65) Prior Publication Data

US 2011/0085892 A1 Apr. 14, 2011

(51) Int. Cl.
*F01D 11/10* (2006.01)

(52) U.S. Cl. ..... 415/173.1; 415/171.1; 415/173.4; 415/173.5; 415/173.6; 415/174.5

(58) Field of Classification Search ..... 415/170.1, 415/171.1, 173.1, 173.4, 173.5, 173.6, 174.4
See application file for complete search history.

(56) References Cited

U.S. PATENT DOCUMENTS 3,897,169 A * 7/1975 Fowler ..... 415/173.6
4,161,318 A 7/1979 Stuart et al.
4,295,787 A * 10/1981 Lardellier ..... 415/197
4,466,772 A 8/1984 Okapuu et al.
4,662,820 A 5/1987 Sasada et al.
5,044,881 A 9/1991 Dodd et al.
5,290,144 A * 3/1994 Kreitmeier ..... 415/173.1
5,639,095 A * 6/1997 Rhode ..... 277/303
6,068,443 A 5/2000 Aoki et al.
6,102,655 A 8/2000 Kreitmeier
6,164,655 A * 12/2000 Bothien et al. ..... 277/303
6,926,495 B2 8/2005 Diakunchak
7,255,531 B2 8/2007 Ingistov
7,445,213 B1 * 11/2008 Pelfrey ..... 277/418

* cited by examiner

*Primary Examiner* — Igor Kershteyn
(74) *Attorney, Agent, or Firm* — Cantor Colburn LLP

(57) ABSTRACT

An apparatus is provided and includes a first member with a flow diverting member extending from a surface thereof and a second member disposed proximate to the first member with a clearance gap area defined between a surface of the second member and a distal end of the flow diverting member such that a fluid path, along which fluid flows from an upstream section and through the clearance gap area, is formed between the surfaces of the first and second members. The second member is formed to define dual vortex chambers at the upstream section in which the fluid is directed to flow in vortex patterns prior to being permitted to flow through the clearance gap area.

20 Claims, 6 Drawing Sheets

VORTEX CHAMBERS FOR CLEARANCE FLOW CONTROL

BACKGROUND OF THE INVENTION

The subject matter disclosed herein relates to vortex chambers for providing tip clearance flow control.

Generally, a turbine stage of a gas engine turbine includes a row of stationary vanes followed by a row of rotating blades in an annular turbine casing. The flow of fluid through the turbine casing is partially expanded in the vanes and directed toward the rotating blades, where it is further expanded to generate required power output. For the safe mechanical operation of the turbine, there exists a minimum physical clearance requirement between the tip of the rotating blade and an interior surface of the turbine casing. Typically, turbine buckets are provided with a cover for better aerodynamic and mechanical performance. A rail protruding out of the cover is used to minimize the physical clearance between the casing and the rotating blade. This clearance requirement varies based on the rotor dynamic and thermal behaviors of the rotor and the turbine casing.

Where the clearance requirement is relatively high, high energy fluid flow escapes between the tip of the blade and the interior surface of the turbine casing without generating any useful power during turbine operations. The escaping fluid flow constitutes tip clearance loss and is one of the major sources of losses in the turbine stages. For example, in some cases, the tip clearance losses constitute 20-25% of the total losses in a turbine stage.

Any reduction in the amount of tip clearance flow can result in a direct gain in power and performance of the turbine stage. Typically, such reductions can be achieved by reducing the physical clearance between the rotor tip and the casing. This reduction, however, also increases the chance of damaging rubbing between the rotating and stationary components.

In addition, turbine engine performance may depend on an amount of cooling and sealing air used to protect the turbine components from high temperatures that exist in hot gas paths. The cooling flow is generally used in the cooling of components and in the purging of cavities that are open to the hot gaspaths. That is, hot gas ingestion to, for example, a wheelspace may be prevented by providing a positive outward flow of cooling air through gaps. Generally, these cooling flows are extracted from the compressor portion of the engine, where any extraction is a penalty to the overall performance of the engine.

BRIEF DESCRIPTION OF THE INVENTION

According to one aspect of the invention, an apparatus is provided and includes a first member with a flow diverting member extending from a surface thereof and a second member disposed proximate to the first member with a clearance gap defined between a surface of the second member and a distal end of the flow diverting member such that a fluid path, along which fluid flows from an upstream section and through the clearance gap, is formed between the surfaces of the first and second members. The second member is formed to define dual vortex chambers at the upstream section in which the fluid is directed to flow in vortex patterns prior to being permitted to flow through the clearance gap.

According to another aspect of the invention, a turbine for providing tip clearance flow control is provided and includes a rotatable turbine blade having a rail extending from a surface thereof and a turbine casing perimetrically surrounding the rotatable turbine blade with a clearance gap defined between an interior surface of the casing and a distal end of the rail such that a fluid path is formed along which fluid flows from an upstream section and through the clearance gap. The turbine casing is formed to define dual vortex chambers at the upstream section in which the fluid is directed to flow in vortex patterns prior to being permitted to flow through the clearance gap.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features without limitation, by way of example with reference to the drawings.

DETAILED DESCRIPTION OF THE INVENTION

In accordance with aspects of the invention, control of tip clearance flow in a gas engine turbine or some other similar apparatus can be achieved without a corresponding reduction in the physical clearance between a rotor tip and a casing. As such, turbine stage performance may be improved without adverse effects on the mechanical integrity of the turbine.

Figure 1:
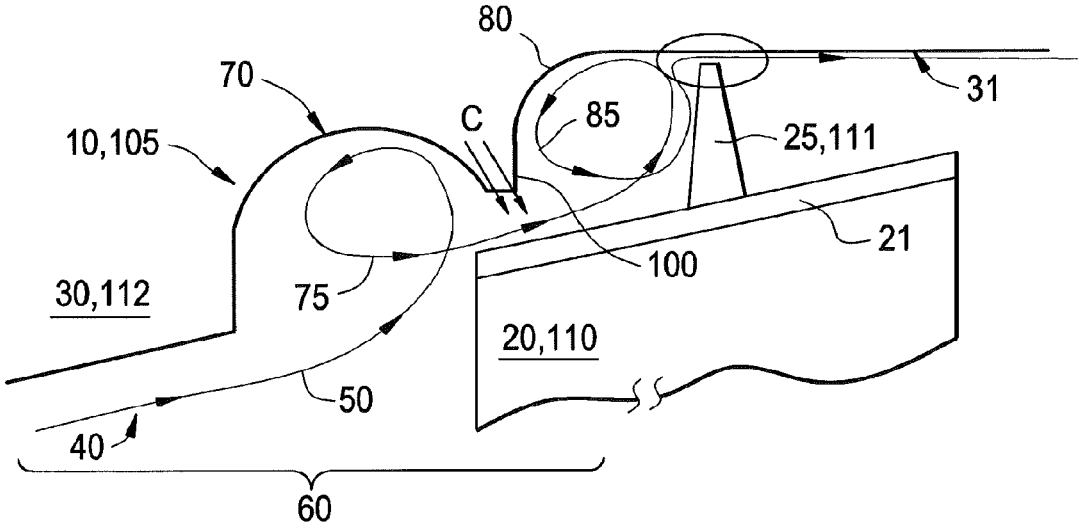
FIGS. 1 and 2 are side sectional views of a turbine casing.
Figure 2:
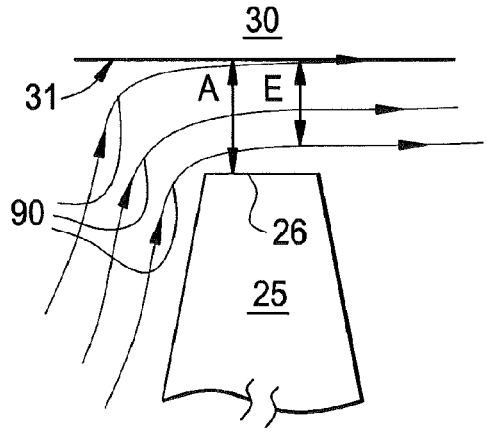
Figure 3:
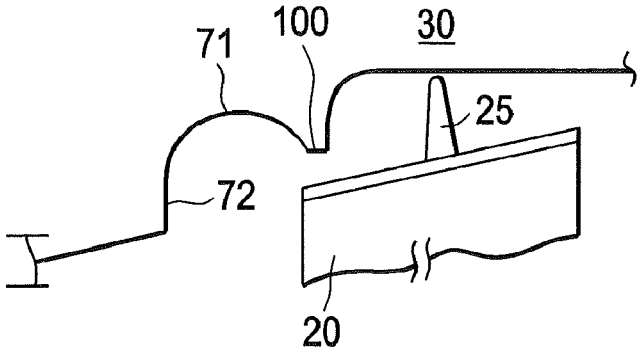
FIG. 3 is a side sectional view of another embodiment of a turbine casing with a bucket.
Figure 4:
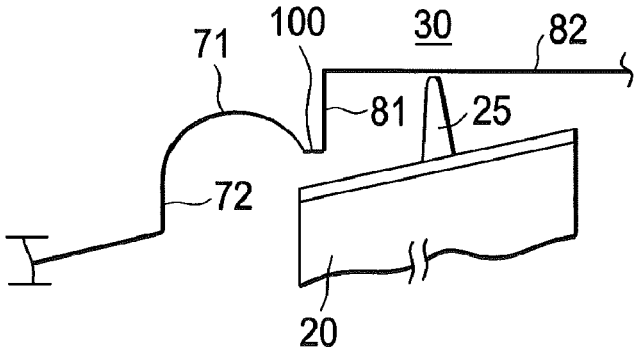
FIG. 4 is a side sectional view of another embodiment of a turbine casing.
Figure 5:
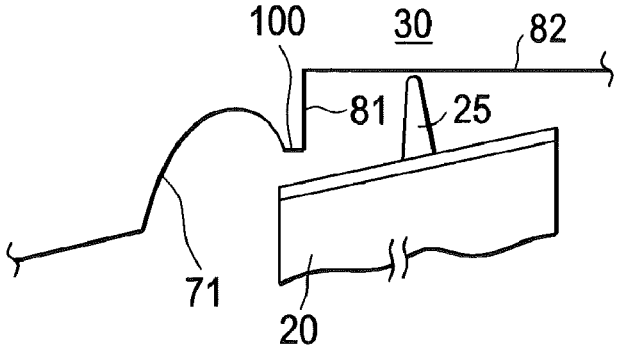
FIG. 5 is a side sectional view of another embodiment of a turbine casing.
Figure 6:
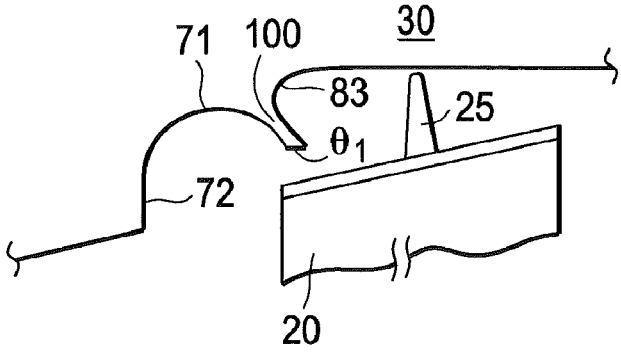
FIG. 6 is a side sectional view of another embodiment of a turbine casing.
Figure 7:
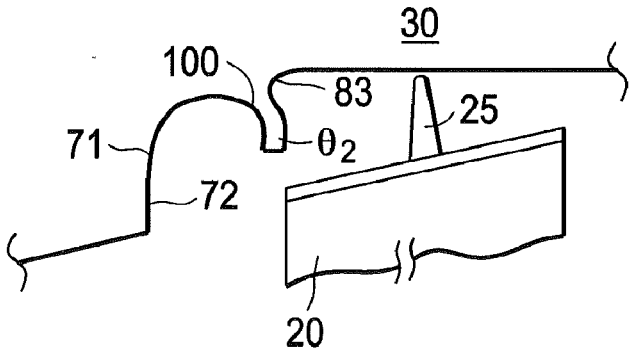
FIG. 7 is a side sectional view of another embodiment of a turbine casing.
Figure 8:
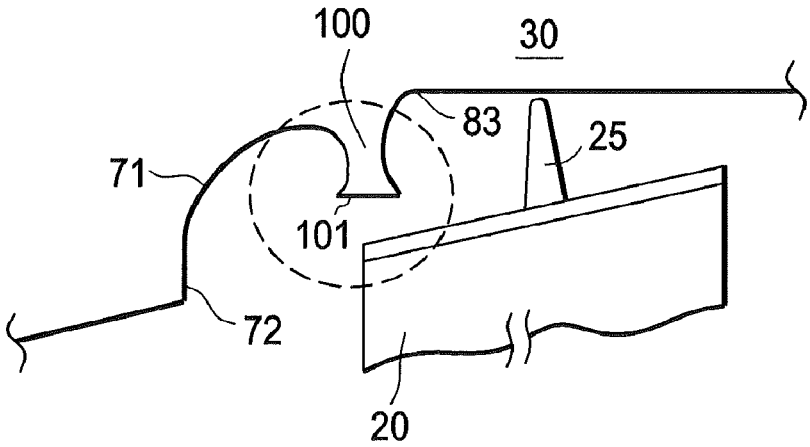
FIG. 8 is a side sectional view of another embodiment of a turbine casing.

With reference to FIGS. 1 and 2, an apparatus 10 is provided and includes first and second members 20 and 30, respectively. The first member 20 includes a flow diverting member 25 extending from a surface 21 thereof. The second member 30 is disposed proximate to the first member 20 with an actual clearance gap area A defined between a surface 31 of the second member 30 and a distal end 26 of the flow diverting member 25. A fluid path 40 is thereby formed between the first and second members 20 and 30 along which fluid 50 may flow from an upstream section 60 in a downstream direction through the actual clearance gap area A.

The second member 30 is further formed to define dual vortex chambers 70 and 80 at the upstream section 60. The fluid 50 is directed to flow into the dual vortex chambers 70 and 80 in dual vortex patterns 75 and 85 prior to being permitted to flow through the actual clearance gap area A. With the fluid 50 being directed to flow in the dual vortex patterns 75 and 85, the effective flow area E of the fluid 50 through the actual clearance area gap A is reduced such that E<A. In detail, the first vortex pattern 75 diverts the flow of the fluid 50 towards the first member 20. The second vortex pattern 85 then directs the flow to take a relatively sharp turn 90 over and around the flow diverting member 25 such that the fluid 50 is prevented from flowing through the full thickness of the actual clearance area gap A. In some cases, the dual vortex chambers 70 and 80 may be configured such that the effective flow area E is significantly less thick than the actual clearance gap area A.

The dual vortex chambers 70 and 80 are formed as an upstream vortex chamber 70 and a downstream vortex chamber 80. The second member 30 may be further formed to define a protrusion 100 between the upstream vortex chamber 70 and the downstream vortex chamber 80.

With reference to FIGS. 3-8, the upstream vortex chamber 70 may include a concave portion 71 or a combination of a wall portion 72 and a concave portion 71 with the concave portion 71 being connected to an outer diameter of the wall portion 72. The downstream vortex chamber 80 may include a wall portion 81 and a tubular portion 82 or a concave portion 83.

The protrusion 100 may be angled in a downstream direction $\theta_1$ or in an upstream direction $\theta_2$. In other cases, the protrusion 100 may include a flare 101 at a distal end thereof. The flare 101 can point in either or both of the upstream and downstream directions.

While the embodiments of FIGS. 3-8 are illustrated separately, it is understood that the various embodiments may be provided in various combinations with one another and that other configurations in line with those described above are possible.

Referring back to FIGS. 1 and 2, in order to achieve a further reduction in the effective clearance gap area E, the second member 30 may be formed to inject or otherwise exhaust a secondary fluid C into the fluid path 40. The secondary fluid C may include coolant and may serve to block the continuous flow of the fluid 50. With the secondary fluid C being coolant, the injection of the secondary fluid C into the fluid path 40 may also provide cooling effects to the various components described herein.

The apparatus 10 may be applied for use in various applications. For example, as shown in FIGS. 1 and 2, the apparatus 10 may be component of a turbine 105 of, e.g., a gas turbine engine. Here, the first member 20 may include a rotatable turbine blade 110, the flow diverting member 25 may include a rail 111 connected to the turbine blade 110 and the second member 30 may include a turbine casing 112 configured to perimetrically surround the turbine blade 110 and the rail 111 with the actual clearance gap area A defined between an interior surface of the turbine casing 112 and a distal end of the rail 111.

That is, a turbine 105 for providing tip clearance flow control is provided and includes a rotatable turbine blade 110 having a rail 111 extending from a surface thereof and a turbine casing 112. The turbine casing 112 is configured to perimetrically surround the rotatable turbine blade 110 and the rail 111 with an actual clearance gap area A that is defined between an interior surface of the turbine casing 112 and a distal end of the rail 111. A fluid path 40 is thereby formed along which fluid 50 can flow from an upstream section 60 and through the clearance gap area A. The turbine casing 112 is further formed to define dual vortex chambers 70 and 80 at the upstream section 60 in which the fluid 50 is directed to flow in vortex patterns 75 and 85 prior to being permitted to flow through the clearance gap area A.

Figure 9:
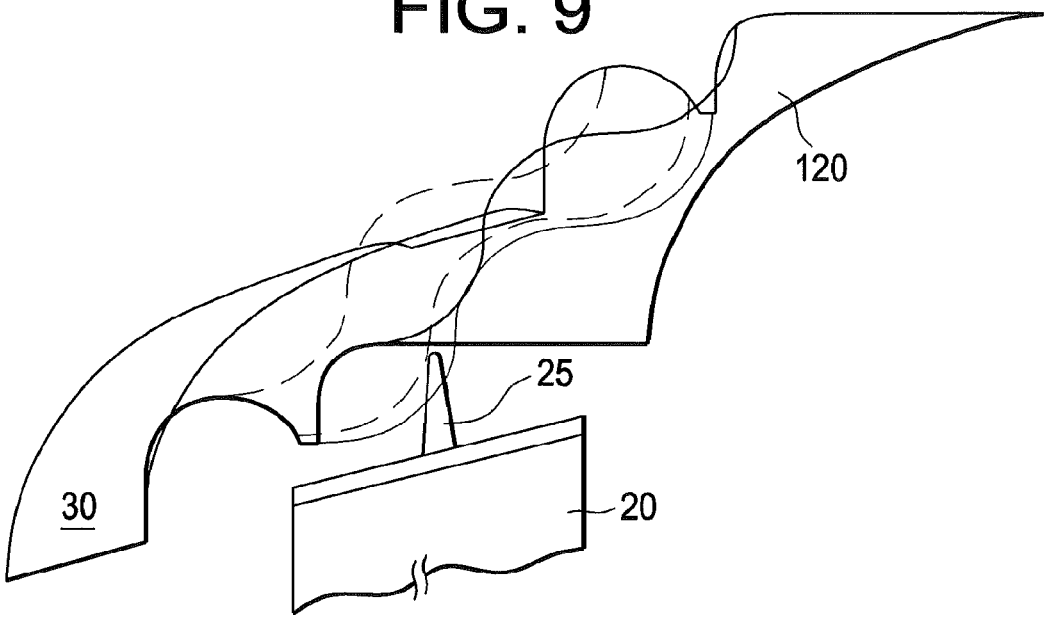
FIG. 9 is a side sectional view of a non-axis-symmetric turbine casing.
Figure 10:
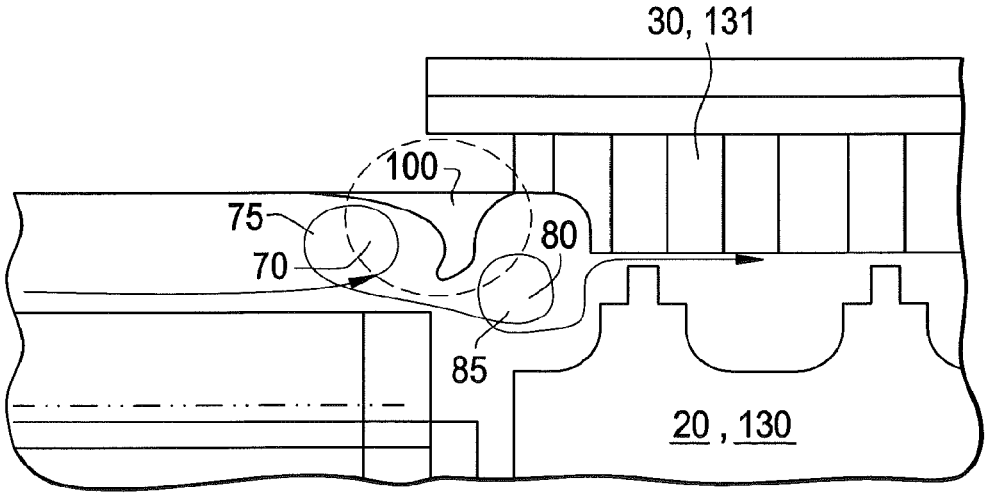
FIG. 10 is a side sectional view of a high pressure pack seal.
Figure 11:
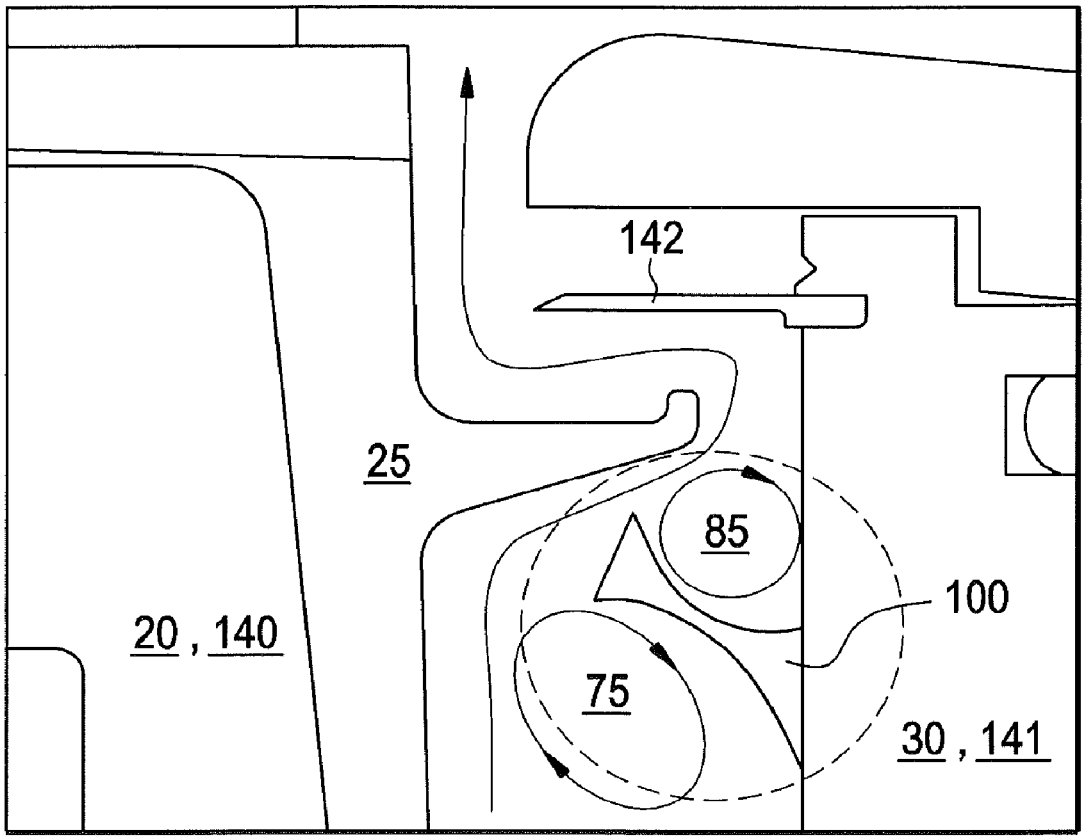
FIG. 11 is a side sectional view of a wheelspace region of a turbine.

As shown in FIG. 9, the second member 30 may also include a non-axis-symmetric casing 120. As shown in FIG. 10, the first member 20 may include a high pressure packing seal 130 that opposes a honeycomb arrangement 131 next to which the protrusion 100 and the dual vortex chambers 70 and 80 are disposed. As shown in FIG. 11, the first member 20 may include a turbine rotor 140 of a wheelspace cavity of a turbine with the second member 30 including a turbine nozzle 141 with a protrusion 100. In this case, the second member 30 may further include a second flow diverting member 142, which is disposed downstream from the flow diverting member 25.

In accordance with other aspects of the invention, a method of operating a turbine 105 is provided. The method includes causing a fluid 50 to flow along a fluid path 40 formed through a turbine casing 112 from an upstream section 60 and through an actual clearance gap area A, which is defined between the turbine casing 112 and a rail 111 of a rotatable turbine blade 110 that is perimetrically surrounded by the turbine casing 112. Prior to permitting the fluid 50 to flow through the actual clearance gap area A, the method further includes directing the fluid 50 to flow in vortex patterns 75 and 85 in dual vortex chambers 70 and 80 at the upstream section 60. In accordance with embodiments, the directing of the fluid 50 may include directing the fluid 50 to flow into an upstream vortex chamber 70 from which the fluid 50 is diverted onto the turbine blade 110, and subsequently directing the fluid 50 to flow into a downstream vortex chamber 80 from which the fluid 50 is forced to turn relatively sharply over the rail 111. In addition, the method may includes exhausting a secondary fluid C, such as a cooling flow, into the fluid 50 during the directing of the fluid 50 to flow in the vortex patterns 75 and 85.

In a simulation, a typical turbine stage with dual vortex chambers 70 and 80 has shown an effective reduction in clearance flow for constant physical clearance gaps with corresponding improvement in stage efficiency. The dual vortex chambers 70 and 80 can be applied to new gas or steam turbines as well as turbines that are already operational. For operational turbines, the dual vortex chambers 70 and 80 can be offered as part of a service package during upgrades.

Figure 12:
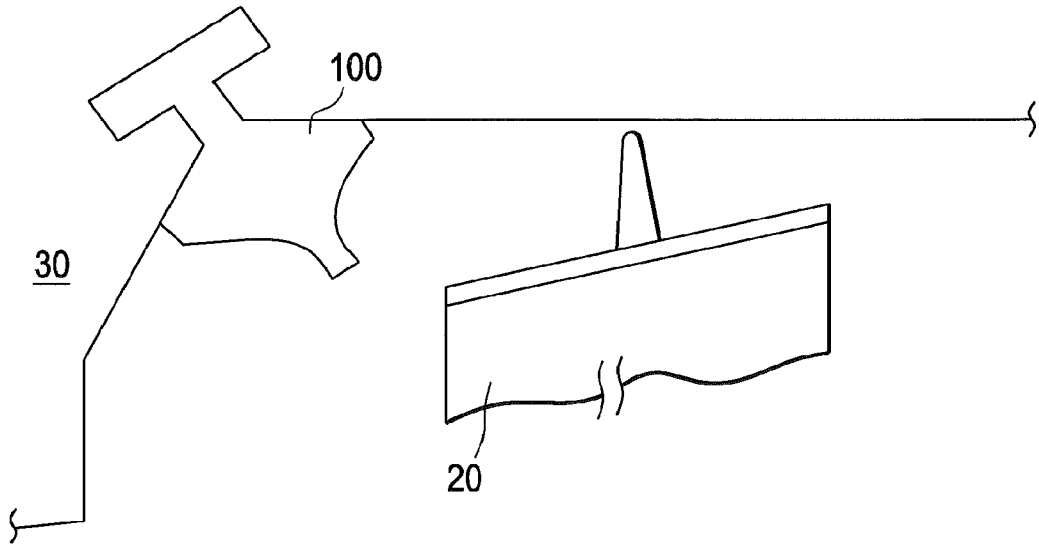
FIG. 12 is a side sectional view of a turbine casing with a protrusion.
Figure 13:
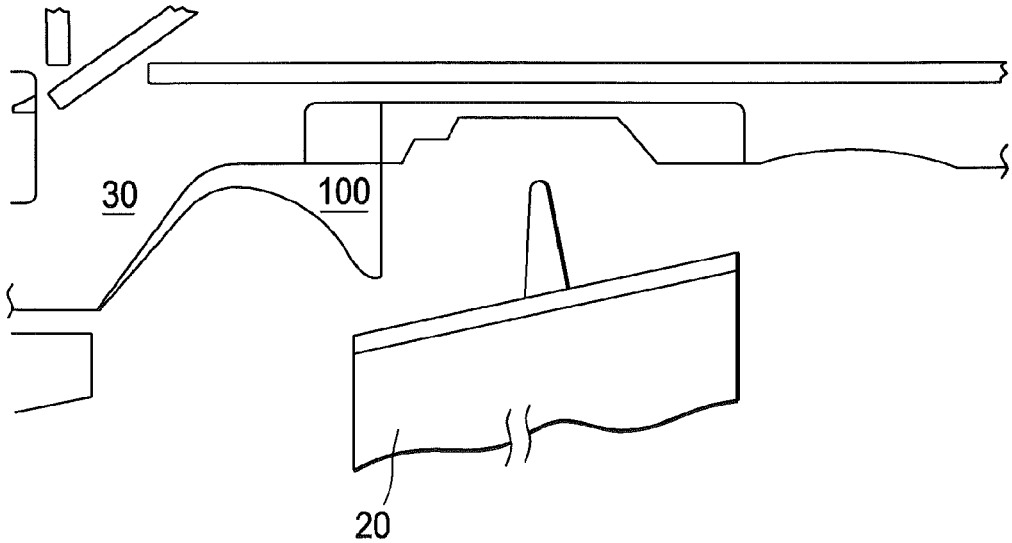
FIG. 13 is a side sectional view of a turbine.

The dual vortex chambers 70 and 80 with protrusion 100 may be created out of a single component or by using multiple components assembled together. One such assembly is shown in FIG. 12, where the protrusion 100 may include a separate removable piece assembled in a casing T-slot. This may be particularly useful during upgrades of engine to incorporate vortex chambers. Generally, the casing over the rail has a tubular shape and, in some cases, the rail may be deployed against an abradable or a honeycomb structure, where the rail is allowed to intentionally form a groove shape during varied operating conditions of a gas turbine engine as shown in FIG. 13.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus, comprising:

a first member with a flow diverting member extending from a surface thereof; and a second member disposed proximate to the first member with a clearance gap area defined between a surface of the second member and a distal end of the flow diverting member such that a fluid path, along which fluid flows from an upstream section, which lacks a gap area between the surface of the second member and the distal end of the flow diverting member of similar dimension as the clearance gap area, and through the clearance gap area, is formed between the surfaces of the first and second members, the second member being formed to define in the upstream section lacking the gap area of similar dimension as the clearance gap area:

dual vortex chambers in which the fluid is directed to flow in vortex patterns prior to being permitted to flow through the clearance gap area.

2. The apparatus according to claim 1, wherein the dual vortex chambers are formed as upstream and downstream vortex chambers with the second member being further formed to define a protrusion axially interposed between the dual vortex chambers, a distance between a distal end of the protrusion and the surface of the first member being larger than the clearance gap area.

3. The apparatus according to claim 2, wherein the upstream vortex chamber comprises a curvilinear concave portion.

4. The apparatus according to claim 2, wherein the upstream vortex chamber comprises a substantially flat, radial wall portion and a curvilinear concave portion connected to an outer diameter of the substantially flat, radial wall portion.

5. The apparatus according to claim 2, wherein the downstream vortex chamber comprises a substantially flat, radial wall portion and a substantially flat, axially tubular portion.

6. The apparatus according to claim 2, wherein the downstream vortex chamber comprises a curvilinear concave portion and a substantially flat, axially tubular portion.

7. The apparatus according to claim 2, wherein the protrusion is angled in a downstream direction.

8. The apparatus according to claim 2, wherein the protrusion is angled in a downstream direction and in an upstream direction with decreasing radial distance from the second member.

9. The apparatus according to claim 2, wherein the protrusion comprises a flare at a distal end thereof.

10. The apparatus according to claim 1, wherein the second member is further formed to radially inwardly exhaust a cooling flow into the fluid path.

11. The apparatus according to claim 1, wherein the first member comprises a rotatable turbine blade, and the second member comprises a turbine casing perimetrically surrounding the turbine blade, wherein the dual vortex chambers are formed as upstream and downstream vortex chambers immediately forward and aft of a forward portion of the rotatable turbine blade, respectively.

12. The apparatus according to claim 11, wherein the turbine casing comprises a non-axis-symmetric casing.

13. The apparatus according to claim 1, wherein the first member comprises a high pressure packing seal.

14. The apparatus according to claim 1, wherein the first member comprises a turbine bucket and the second member comprises a turbine nozzle.

15. The apparatus according to claim 1, wherein the second member further comprises a second flow diverting member downstream from the flow diverting member of the first member.

16. A turbine for providing tip clearance flow control, the turbine comprising:

a rotatable turbine blade having a rail extending from a surface thereof; and a turbine casing perimetrically surrounding the rotatable turbine blade with a clearance gap area defined between an interior surface of the casing and a distal end of the rail such that a fluid path is formed along which fluid flows from an upstream section, which lacks a gap area between the interior surface of the casing and the distal end of the rail of similar dimension as the clearance gap area, and through the clearance gap area, the turbine casing being formed to define in the upstream section lacking the gap area of similar dimension as the clearance gap area:

dual vortex chambers in which the fluid is directed to flow in vortex patterns prior to being permitted to flow through the clearance gap area whereby the fluid is forced to turn sharply around the rail such that an effective flow area of the fluid through the clearance gap area is less thick as measured from the interior surface of the turbine casing than the clearance gap area.

17. The turbine according to claim 16, wherein the protrusion is removable.

18. The turbine according to claim 16, wherein the turbine casing comprises at least one of a concave portion, a wall portion and a tubular portion.

19. The turbine according to claim 16, wherein the rail forms a groove in the interior surface of the turbine casing.

20. The turbine according to claim 19, wherein the turbine casing comprises at least one of an abradable and a honeycomb surface.

* * * * *